US005133555A

United States Patent [19]

Bailey

[11] Patent Number: 5,133,555

[45] Date of Patent: Jul. 28, 1992

[54] GOLF PUTTER

[76] Inventor: Howard L. Bailey, 1509 W. Seldon La., Phoenix, Ariz. 85021

[21] Appl. No.: 808,092

[22] Filed: Dec. 16, 1991

[51] Int. Cl.[5] ..... A63B 53/02; A63B 53/14

[52] U.S. Cl. ..... 273/164; 273/81 B; 273/80 C; 273/80 A; 273/77 R

[58] Field of Search ..... 273/162 R, 81 B, 81.3, 273/81.4, 80 A, 80 C, 167 G, 167 K, 77 R, 163 R, 163 A, 164

[56] References Cited

U.S. PATENT DOCUMENTS

| | | | |
|---|---|---|---|
| D. 208,058 | 7/1967 | Johnston | D34/5 |
| D. 213,838 | 4/1969 | McAllister | 273/80 C X |
| D. 257,050 | 9/1980 | Cicero | D21/214 |
| D. 313,057 | 12/1990 | Gebbardt | D21/217 |
| 2,478,468 | 8/1949 | Drake | 273/77 |
| 3,062,549 | 11/1962 | Duden | 273/81.3 |
| 3,064,975 | 11/1962 | Smith | 273/80 |
| 3,066,936 | 12/1962 | Hyde | 273/80 |
| 3,109,653 | 11/1963 | Biggs | 273/165 |
| 3,176,987 | 4/1965 | Johnston | 273/77 |
| 3,295,850 | 1/1967 | Garrity | 273/81.4 |
| 3,319,962 | 5/1967 | Summers | 273/164 X |
| 3,955,819 | 5/1976 | Yokich | 273/164 |
| 4,138,117 | 2/1979 | Dalton | 273/80 C X |
| 4,140,318 | 2/1979 | Izett et al. | 273/167 A |
| 4,227,694 | 10/1980 | Drake | 273/80 C X |
| 4,754,976 | 7/1988 | Pelz | 273/80 C X |
| 4,966,369 | 10/1990 | Griffin | 273/80 |

*Primary Examiner*—George J. Marlo
*Attorney, Agent, or Firm*—Warren F. B. Lindsley

[57] ABSTRACT

A putter having a shaft which curves away from the putter face to cause the putter face to be moved 8½ to 10 inches ahead of traditional style putters when the flat portion of the sole of the putter is seated on the green when used with an open stance. The grip or handle of the putter is provided with a flat surface which is parallel with the planar striking face of the club head for improved guidance of the arm and palm of the golfer as the golfers hand moves in the direction of the cup.

2 Claims, 1 Drawing Sheet

C.G.

GOLF PUTTER

BACKGROUND OF THE INVENTION

This invention relates to golf clubs and more particularly to a putter which affords a better visual alignment and kinesthetic movement of the golf club so that initial address of the golf ball can be accurately judged by the golfer.

To assist the golfer in doing this, many clubs include visual alignment devices so that the initial address of the ball can be accurately judged by the golfer. With this invention, all of the features of the putter are designed to afford this accuracy. In the United States alone, over 21,000,000 people play golf. Of these, 10% more than likely use an open stance while putting. The disclosed putter has been designed for those golfers. In the traditional stance, the center line of the feet are 90° to the target line. In the open stance, the center line of the feet open up to and include 45° off the target line.

None of the prior art golf clubs and especially the putter accomplishes the desired end result, namely a putter that permits a golfer to properly address a golf ball when using an open stance.

DESCRIPTION OF THE PRIOR ART

The following patents appear to be of novelty interest but none are believed to disclose the invention claimed.

U.S. Pat. Nos. 3,062,549 and 3,319,962 both disclose putters designed to be used croquet style. Although of a different style putter, U.S. Pat. No. 3,062,549 discloses a putter the sole of which slopes sled-runner style from the striking face toward its trailing edge.

U.S. Pat. No. D313,057 discloses a putter having a curved neck which curves away from the putter face.

U.S. Pat. Nos. 2,478,468; 3,176,987 and D208,058 show various sole features of the golf club heads.

Other patents of general interest comprise the following:

4,966,369
3,109,653
4,140,318
3,066,936
3,955,819
3,064,975
3,295,850
D257,050

The need for a putter that will afford a better visual alignment and kinesthetic movement of the golf club still exists.

SUMMARY OF THE INVENTION

In accordance with the invention claimed, a new and improved putter is provided, the hozel of which curves away from the putter face to cause the putter face and head to be moved 1-⅛ inches ahead of the traditional style putter head wherein the shaft lines up with the face of the putter. The sole of the putter is designed to allow the ball to be played 8-½ to 10 inches ahead of the traditional placement of the ball when using an open stance. Further, the putter grip is improved for better hand guidance by having the flat portion of the grip on the back side of the shaft thereby allowing the arm and palm of the hand using a piston stroke to move the club head in the direction of the target.

It is, therefore, one object of this invention to provide an improved putter for affording a better visual alignment and kinesthetic movement of the golf club with the open stance.

Another object of this invention is to provide an improved putter in which its shaft curves away from the putter face for better visual alignment by moving the putter head forward of traditional putters.

A further object of this invention is to provide a sole for the putter head which allows proper placement of the putter head in advance of traditional ball placement in the stance.

A still further object of this invention is to provide a putter grip for better hand guidance wherein the flat portion of the grip is on the back side of the shaft thereby causing the arm and palm of the hand to move in the direction of the target using a piston type stroke.

Further objects and advantages of the invention will become apparent as the following description proceeds and the features of novelty which characterize this invention will be pointed out with particularlity in the claims annexed to and forming part of this specification.

BRIEF DESCRIPTION OF THE DRAWING

The present invention may be more readily described by reference to the accompanying drawing, in which.

DESCRIPTION OF THE PREFERRED EMBODIMENT

Figures 1, 2, 3, 4, 5, 6A, 6B, 7A, 7B:
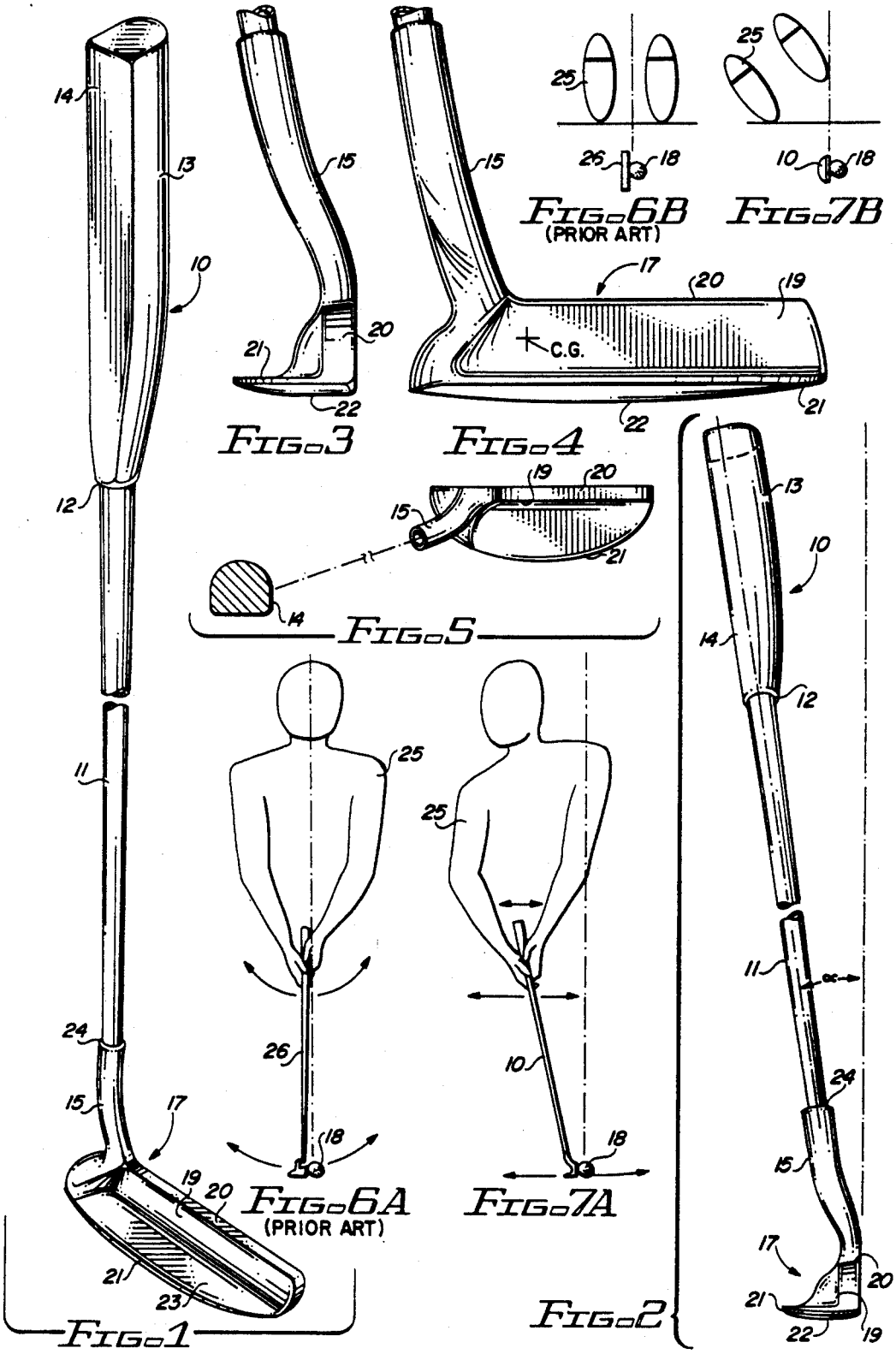
FIG. 6A (PRIOR ART)
FIG. 6B (PRIOR ART)
FIG. 1 is a perspective view of a putter.
FIG. 2 is a end elevational view of the putter shown in FIG. 1.
FIG. 3 is an enlargement of the putter head shown in FIG. 2.
FIG. 4 is an enlargement of the rear view of the putter head shown in FIG. 1.
FIG. 5 is an exploded view showing the flat surface of the grip parallel and offset from the parallel surface of the putter head.
FIGS. 6A and 6B illustrate a prior art putter and the golfer's approach to the ball.
FIGS. 7A and 7B illustrate the putter and golfer's approach to the ball and involving the invention.

Referring more particularly to the drawing by characters of reference, FIGS. 1–4 disclose an improved putter 10 comprising an elongated shaft 11 of generally tubular configuration. The shaft may be made of metal, such as aluminum or glass fiber or the like. The upper end of the shaft 11 is provided with a handle portion 12 having a suitably affixed hand grip 13 formed at its end. The front face 14 of the handle portion is flattened to properly position the palm and fingers of the hand for better gripping of the shaft and to facilitate alignment of the putter.

Shaft 11 is rigidly affixed at its lower end to a hozel 15 at one end of a club head 17 which hozel is curved or bent rearwardly of the planar face of the golf club. Club head 17 is formed of a suitable relatively heavy mass such as, for example, aluminum, brass or steel as compared to the mass of a golf ball 18 to be propelled thereby. Shaft 11 is secured through hozel 15 to head 17 of the golf club at one end thereof such that the axis of shaft 11 extends through the head of the club in back of its center of gravity. The configuration of head 17 is best seen in FIGS. 1, and 4 which includes a blade 19 having a straight upper edge 20. Formed integral with the lower rear edge of blade 19 is a flange 21 which is of a length equal to the length of the blade, the rear edge of the flange being curved, as shown in FIGS. 2 and 3 of the drawing. Flange 21 curves upwardly from the lower edge or grounding surface 22 of blade section 19 so that when the club is properly grounded, most of flange 21 will be spaced from the green or putting surface. This correct position of the face takes place only when the sole is set squarely on the putting surface. Thus, it will be seen that when the club head is moved toward the ball in a putting effort the chances of the sole of the putter scuffing the green or putting surface is reduced. However, at the point of impact with the ball the grounding surface 22 is flat on the green or putting surface.

As known in the art, shaft 11 is rigidly affixed to an opening 24 in hozel 15 which is attached to the rear of club head 17. The shaft may be held in opening 24 by a force fit or may be connected to the hozel by a suitable adhesive or bonding process compatible with the materials used.

The disclosed invention comprises three unique and novel concepts, namely hozel 15 of the golf club head is curved away from the face of the putter, the sole of the putter is designed to provide a proper seating of the golf head when it is placed 8-½ to 10 inches ahead of traditional placement, and the flat side of the grip of the golf club is parallel with the flat ball engaging surface of the head of the putter.

The curved neck feature permits the putter face to be moved ahead of the traditional style putters where the shaft lines up with the face of the putter head for better visual alignment when used with an open stance.

By positioning the flat side of the hand grip of the golf club parallel with the flat front face of the putter head, the golfer has his or her palm at right angles to the cup for proper hand and putter guidance.

FIGS. 6A and 6B illustrate the traditional stance of a golfer 25 using a traditional putter 26 with relationship to ball 18.

FIGS. 7A and 7B illustrate the stance of golfer 25 addressing ball 18 with the putter 10 disclosed and claimed herein wherein the grounding surface 22 of the club head is flat on the ground at the time the face of the club engages the ball 8-½ to 10 inches ahead of the traditional positioning of the golf club.

Although but one embodiment of the invention has been shown and described, it will be apparent to those skilled in the art that various changes and modifications may be made therein without departing from the spirit of the invention or from the scope of the appended claims.

What is claimed is:

1. A golf putter comprising:

a shaft having an elongated handle portion at the upper end thereof, a head affixed to the lower end of said shaft and having a planar ball striking face on the front thereof, a flange extending laterally rearward of said planar striking face which together with the base of said planar striking face forms a sole for said head and a hozel fastening said head to the lower end of said shaft, said hozel being inclined upward and rearwardly of said planar striking face so that the axis of said shaft extends through said head and rearward of its center of gravity and the handle position is placed 8½–10 inches rearward of the striking face when properly addressing a golf ball with said putter, the rearward surface of said handle portion being flattened longitudinally along a portion thereof and extending generally parallel to said planar striking face of said head, and said sole being inclined upward and rearward from a point intermediate the ends thereof.

2. The golf putter set forth in claim 1 wherein:

said hozel is affixed to said head at one end thereof.

* * * * *